US005940993A

United States Patent [19]

Ronci

[11] Patent Number: 5,940,993

[45] Date of Patent: Aug. 24, 1999

[54] GOLF CLEAT

[76] Inventor: Fernando F. Ronci, 61 Reservoir Rd., Lincoln, R.I. 02865

[21] Appl. No.: 09/031,134

[22] Filed: Feb. 26, 1998

[51] Int. Cl.[6] ..... A43B 5/00; A43B 15/00

[52] U.S. Cl. ..... 36/134; 36/127; 36/67 D

[58] Field of Search ..... 36/127, 134, 67 R, 36/67 D

[56] References Cited

U.S. PATENT DOCUMENTS

| | | | |
|---|---|---|---|
| 180,578 | 8/1876 | Gunsalus | 36/67 D |
| 383,133 | 5/1888 | Kingston et al. . | |
| 1,961,555 | 6/1934 | Driscoll | 36/7.7 |
| 1,998,342 | 4/1935 | Sturgeon | 36/7.7 |
| 2,607,134 | 8/1952 | Langer | 36/59 |
| 2,745,197 | 5/1956 | Holt | 36/2.5 |
| 3,066,425 | 12/1962 | Koley | 36/2.5 |
| 3,656,245 | 4/1972 | Wilson | 36/67 D |
| 3,668,792 | 6/1972 | York | 36/59 R |
| 3,866,339 | 2/1975 | Latto | 36/7.6 |
| 4,004,356 | 1/1977 | Green | 36/134 |
| 4,014,114 | 3/1977 | Jordan et al. | 36/67 D |
| 4,299,038 | 11/1981 | Epple | 36/67 D |
| 4,357,763 | 11/1982 | Fleischmann et al. | 36/67 D |
| 4,492,047 | 1/1985 | Arff | 36/134 |
| 4,644,672 | 2/1987 | Dassler et al. | 36/134 |
| 4,782,604 | 11/1988 | Wen-Shown | 36/127 |
| 4,922,636 | 5/1990 | Chen | 36/127 |
| 5,025,576 | 6/1991 | Biasiotto et al. | 36/134 |
| 5,197,210 | 3/1993 | Sink | 36/127 |
| 5,243,775 | 9/1993 | Swain | 36/134 |
| 5,243,776 | 9/1993 | Zelinko | 36/134 |
| 5,299,369 | 4/1994 | Goldman | 36/61 |
| 5,337,494 | 8/1994 | Ricker | 36/61 |
| 5,367,793 | 11/1994 | Deacon et al. | 36/134 |
| 5,469,644 | 11/1995 | Vidler | 36/127 |
| 5,475,937 | 12/1995 | Korsen | 36/134 |
| 5,533,282 | 7/1996 | Kataoka et al. | 36/134 |
| 5,727,340 | 3/1998 | Suk | 36/134 |
| 5,782,017 | 7/1998 | Ortscheid | 36/134 |
| 5,794,367 | 8/1998 | Carroll | 36/134 |

*Primary Examiner*—M. D. Patterson
*Attorney, Agent, or Firm*—Barlow, Josephs & Holmes, Ltd.

[57] ABSTRACT

A golf cleat having a base member with an array of peripheral projections and a central projection is provided. The golf cleat includes reinforcement ribs spanning from the central projection to each of the peripheral projections, respectively. The golf cleat is manufactured of a durable yet flexible material so that the projections may compress and move relative to one another to accommodate a wide range of terrain surfaces, including irregularly shaped terrain surfaces. The reinforcement rib members ensure that each peripheral projection springs back to its original position after flexing to accommodate a particular terrain surface and does not tear away over time.

3 Claims, 5 Drawing Sheets

GOLF CLEAT

This patent application is a related application to pending U.S. patent application Ser. No. 29/084,186 filed Feb. 23, 1998.

BACKGROUND OF THE INVENTION

The present invention relates generally to a shoe cleat. More specifically, the present invention relates to an athletic shoe cleat with particular application in the golf shoe industry to provide improved traction control and self-cleaning capabilities.

In the field of athletic shoe cleats, it has been well-known to employ an array of cleat members on the bottom of the athletic shoe to provide improved traction on the playing surface used in the sport being played by the user of the athletic shoe. In particular, it has been well-known to include a series of individual cleat members which can be separately threaded into the sole of the athletic shoe. In the event that one of the cleat members breaks or is lost, it can be easily replaced by attachment of a new cleat member. Typically, athletic shoes include female-threaded receptacles for receiving the individual traction cleats. Each of the cleats commonly include a male-threaded post member for threadable removable connection to the shoe sole.

For example, athletic shoe cleats, such as in the golf industry, typically include a series of cleat members positioned about the bottom of the shoe sole in a particular array to provide traction and a spaced-apart configuration over the shoe sole. Common golf cleats, otherwise known as spikes, have been made of metal material and configured into a single spike structure to provide the necessary traction on the golf course. However, recently, metal golf spikes have fallen into disfavor by golf courses due to the damage that they cause to greens and surrounding areas. The protruding metal spike common to golf shoes is slowly being replaced by alternative spike and traction cleats which provided much less damage to golf courses. Recently, there's been particular need for alternatives to the common metal spike cleats in light of the fact that many golf courses are completely banning their use.

There have been attempts in the prior art to provide an alternative to the metal golf spike. For example, plastic cleats with shorter spike protrusion members have been provided to lessen the overall piercing of the cleats to help reserve the golf courses. These plastic cleats commonly include an array of protrusions positioned over the surface of the cleat to provide the necessary traction. However, these prior art plastic cleats or spikes are typically manufactured of hard plastic resulting in good traction but suffer from the disadvantage of being extremely slippery, not durable or long-wearing, dangerous and subject to being easily packed with dirt requiring frequent cleaning. Also, golf cleats had been provided of a very soft material which suffers from the disadvantages of poor traction and easy breakage of the individual protrusions on the cleat.

A common problem associated with all plastic golf cleats is the difficulty in maintaining the individual golf cleats within their respective female-threaded receptacles in the shoe sole. The use of plastic, particularly soft plastic, is particularly sensitive to high temperatures which results in undesirable creep of the plastic causing thread stripping, thread breakage, and the like. As a result, is not uncommon for plastic cleats to fall out of the respective receptacles requiring frequent replacement. In light of the foregoing, the replacement cleat systems for the older metal spike cleats require significant maintenance and additional associated cost.

Due to the demand for a golf cleat, which can successfully replace metal golf spikes to comply with recent golf regulations, it is desirable for a golf cleat to be made of flexible plastic for comfort while providing superior traction and self-cleaning capabilities to decrease the overall maintenance and associated cost of using such plastic cleats. Is also desirable to provide a golf cleat which not only provides traction on a golf course but safety traction on non-grass and non-sand terrain, such as steps, asphalt, tile, oak and other types of flooring. Is also desirable for a golf cleat to be securely installed in its receptacle on the sole of a golf shoe to avoid the cleat from backing out and being lost. Still further, is desirable that the golf cleat provide superior traction without danger of the protrusions on the cleat being broken off.

SUMMARY OF THE INVENTION

The present invention preserves the advantages of prior art athletic shoe cleats and particularly golf cleats. In addition, it provides new advantages not found in currently available golf cleats, and overcomes many disadvantages of such currently available cleats.

The invention is generally directed to a novel and unique shoe cleat with particular application in replacing metal golf spikes as well as soft golf spikes currently on the market. The golf cleat of the present invention enables the simple, easy and inexpensive manufacture of a golf cleat while producing a golf cleat with superior surface traction and self-cleaning capabilities. In addition, the present invention enables the end-user of the golf cleat to enjoy maintenance-free use without fear of breakage or loss of the cleats.

The preferred embodiment of the present invention provides a demountable shoe cleat adapted to be attached to the sole of a shoe, having female-threaded cleat receptacles, for engagement with a surface. The shoe cleat includes a base member having a first side adapted to abut the sole of the shoe, when the cleat is mounted on the shoe, and a second side. The male threaded post is connected substantially perpendicular to the first side of the base member where the male threaded post is removably engaged with the female cleat receptacle of the shoe and is substantially centrally positioned on a first side of the base member. A number of peripheral projections are connected to and extend from the second side of the base member about the periphery of the base member. The projections are each flexible and movable relative to the base member. A central projection is connected to and extends from the second side of the base member. The central projection is substantially centrally positioned on the second side of the base member. A number of reinforcement ribs are connected to and extend from the second side of the base member where the reinforcement ribs span from the central projection, respectively, to each of the number of peripheral projections. When the golf cleat is installed and in contact with a surface, the peripheral projections and the central projection adapt to accommodate the surface terrain while ejecting any dirt lodged within the golf cleat construction.

It is therefore an object of the present invention to provide a golf cleat that can effectively replace a metal golf spike.

Another object of present invention is to provide a golf cleat which has superior traction.

It is a further object of the present invention to provide a golf cleat that includes a center protrusion for added grip and support.

It is yet a further object of the present invention to provide a golf cleat that is soft and comfortable to the user.

It is another object of present invention to provide a golf cleat that can easily adapt to uneven terrain while providing superior traction.

Another object of the present invention is to provide a golf cleat that is self-cleaning.

It is yet another object of the present invention to provide a golf cleat that includes tension lock threading to avoid cleat loss and breakage.

It is another object of the present invention to provide a golf cleat which, over time, becomes more elastomeric resulting in superior gripping traction.

It is a further object of the present invention to provide a golf cleat which provides wedge shaped regions for additional lateral support.

It is another object of the present invention to provide a golf cleat which includes ribs to protect the wearing down of the projections and prevent projection rotation on golf greens.

BRIEF DESCRIPTION OF THE DRAWINGS

The novel features which are characteristic of the present invention are set forth in the appended claims. However, the inventions preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1:
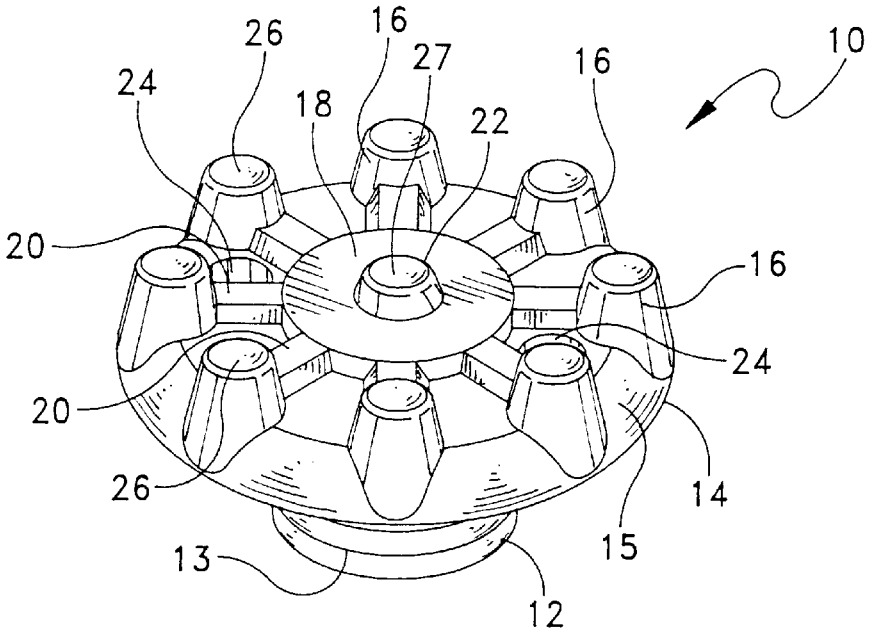
FIG. 1 is a top perspective view of the golf cleat of the present invention.
Figure 2:
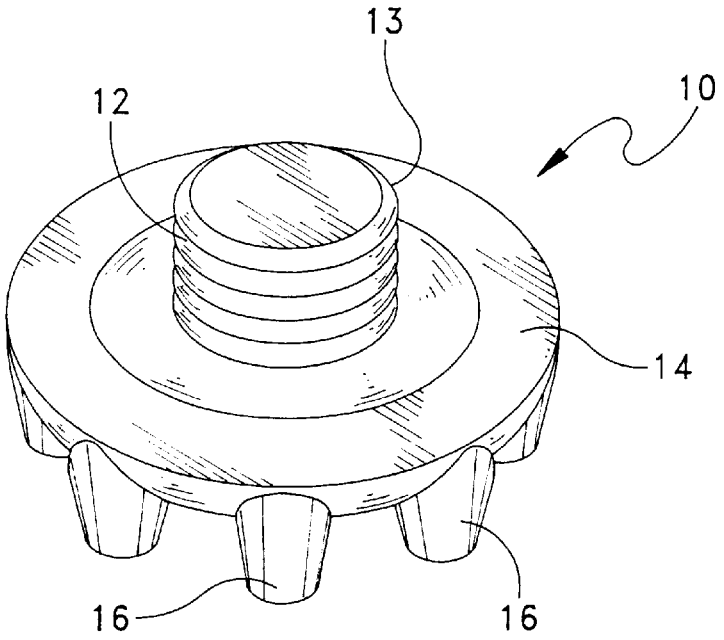
FIG. 2 is a bottom perspective view of the golf cleat of the present invention.

Referring to FIGS. 1 and 2, top and bottom perspective views are, respectively, shown. The golf cleat 10 of the present invention includes base member 14 and male-threaded post 12, with male threads 13, connected to one side thereof. The opposing side of base member 14 includes a number of spikes or projections 16 having contact surfaces 26. These projections 16 are preferably positioned about the peripheral edge of base member 14 and proximal to the tapered edge 15 of base member 14. Projections 16 are preferably arranged in a circular array on base member 14.

In addition, base member 14 carries a center pad 18 which, in turn, carries central projection 22 thereon. Central projection 22 further includes a central projection contact surface 27. Ribs 20 are provided between each projection 16 and center pad 18 to provide additional reinforcement for projections 16. Disposed within base member 14 is a pair of apertures 24 for receiving a standard golf spike removal tool for facilitating the installation and removal of golf cleat 10 in a golf shoe.

Figure 3:
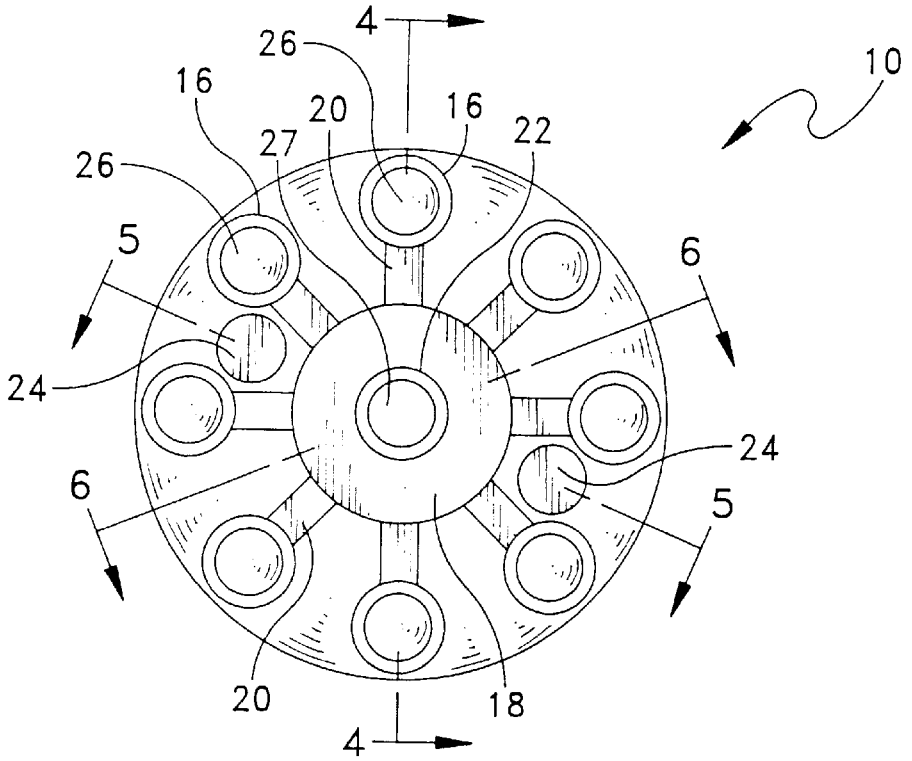
FIG. 3 is top view of the golf cleat of FIG. 1.
Figure 4:
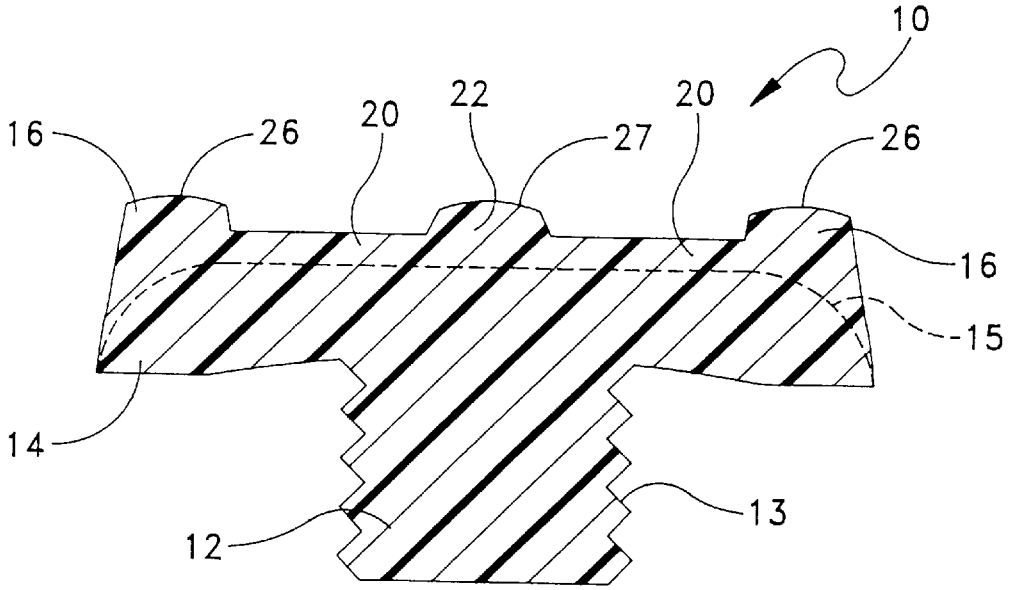
FIG. 4 is a cross-sectional view through the line 4—4 of FIG. 3.

Turning now to FIG. 3–6, details of the construction of the golf cleat 10 of the present invention is shown. FIG. 3 illustrates a top plan view of golf cleat 10. In particular, the concentric or circular array of projections 16 can be easily seen. Further, center pad 18 and central projection 22 is shown to be positioned substantially at the center of the circular array of projections 16. Reinforcement ribs 20 extend outwardly in a spoke-like pattern from center pad 18 to connect with each projection 16. FIG. 4 illustrates a cross-sectional view through the line 44 of FIG. 3 to illustrate the cross-section through ribs 20. The use of reinforcement ribs 20, spanning between central projection 22 and peripheral projection 16, provides additional cleat material above base member 14 as indicated by the dotted line. As will be discussed in detail below, reinforcement ribs 20 provide additional support and spring action for projections 16 during use.

Figure 5:
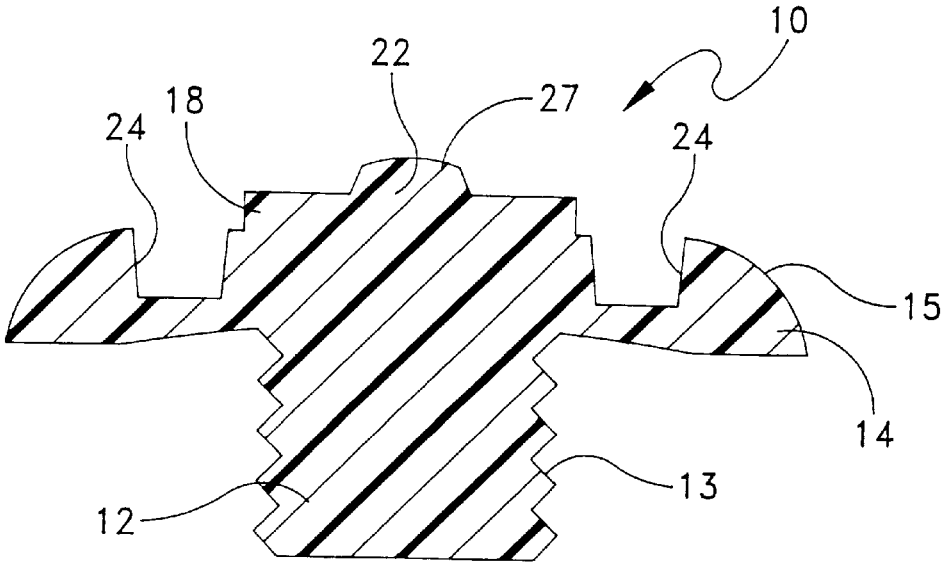
FIG. 5 is a cross-sectional view through the line 5—5 of FIG. 3.
Figure 6:
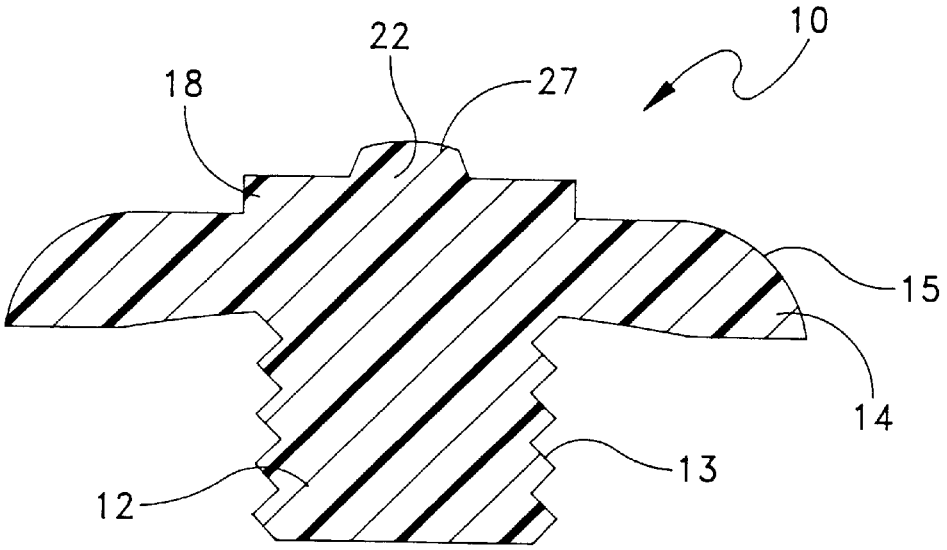
FIG. 6 is a cross-sectional view through the line 6—6 of FIG. 3.

In FIG. 5, a cross-sectional view through the line 5—5 of FIG. 3 is shown. FIG. 5 is a cross-sectional view taken through apertures 24 which received a golf spike removal tool. Aperture 24 reside on opposing sides of central projection 27 to facilitate rotation of golf cleat 10 about threaded post 12 during installation and removal. FIG. 6 further illustrates a cross-sectional view taken through the line 6—6 of FIG. 3 to show the construction of golf cleat 10 at its base member 14. In particular, FIG. 6 illustrates base member 14 to include a radius tapered edge 15.

Golf cleat 10 is preferably manufactured of elastomeric urethane material which is rugged and durable yet flexible enough to compress and bend under the pressure of the weight of the user of the golf cleat 10. An elastomeric compound is employed to manufacture the golf cleat of the present invention which includes a catalyst and an elastomer. Unlike common injected molded plastics used in prior art golf cleats, the elastomeric compound used in the present invention takes 10 minutes to demold and 5 days to cure which significantly adds to its durability.

Figure 7:
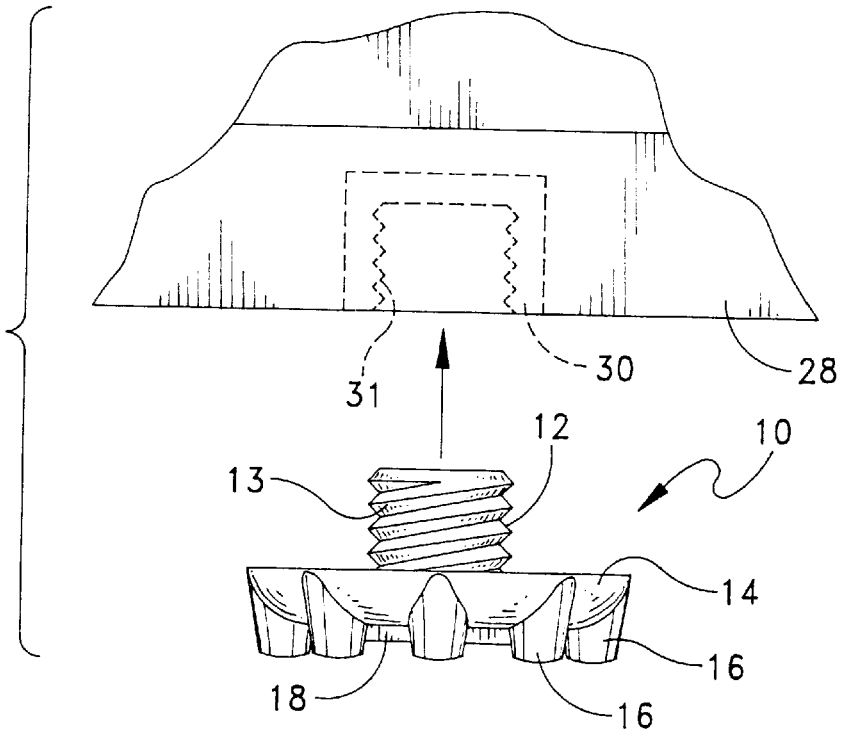
FIG. 7 is a side elevational view of the golf cleat of FIG. 1 in the process of being installed in a golf shoe in accordance with the present invention.
Figure 8:
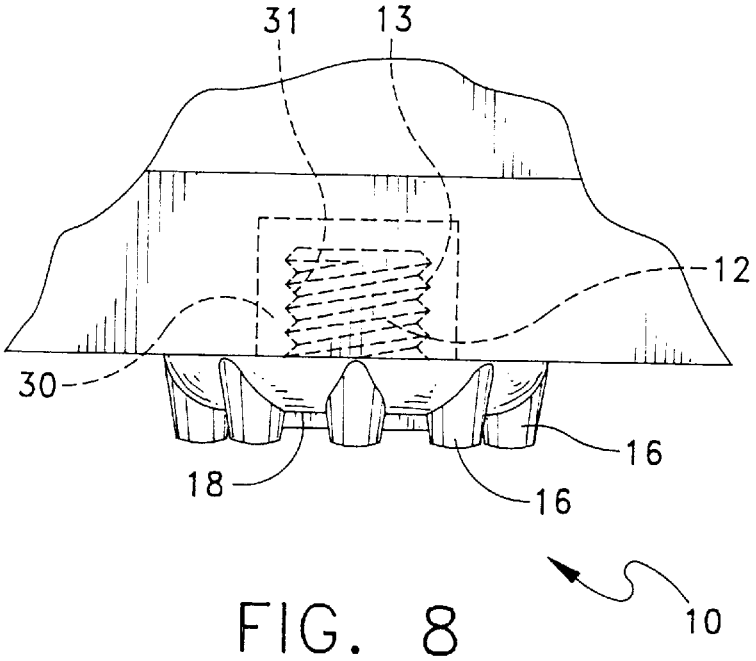
FIG. 8 is a side elevational view of the golf cleat of FIG. 1 installed in a golf shoe in accordance with the present invention.

Referring now to FIGS. 7 and 8, installation of golf cleat 10 is shown. FIG. 7 shows a shoe sole 28 with a cleat receptacle 30 with female threads 31 therein. Cleat receptacle 30 is provided for receiving golf cleat 10 therein. It should be understood that entire array of cleat receptacles 30 are provided on a given shoe sole 28. For ease of illustration, installation and later use of a single of cleat 10 will be discussed. FIG. 7 shows golf cleat 10 in an inverted position with its threaded post 12 pointed in an upward direction. Threaded post 12 is threaded into receptacles 30 so that male threads 13 engage with female threads 31. With the assistance of a standard golf spike removal tool (not shown) which has a pair of protrusions for engagement of apertures 24, golf cleat 10 may be snugly installed into receptacle 30, as shown in FIG. 8. It is preferred that cleat receptacle 30 includes female threading with a thread diameter which is slightly smaller than a thread diameter of male threads 13 of threaded post 12. As a result, during the installation process, threaded post 12, namely male threads 13, compress slightly when threaded into female threads 31 of receptacles 30. Male threads 13, when installed into receptacles 30 as shown in FIG. 8, tend to expand slightly thus gripping female threads 31 to provide a torsion lock effect to help prevent golf cleat 10 from backing out of receptacle 30 in shoe sole 28.

Figure 9:
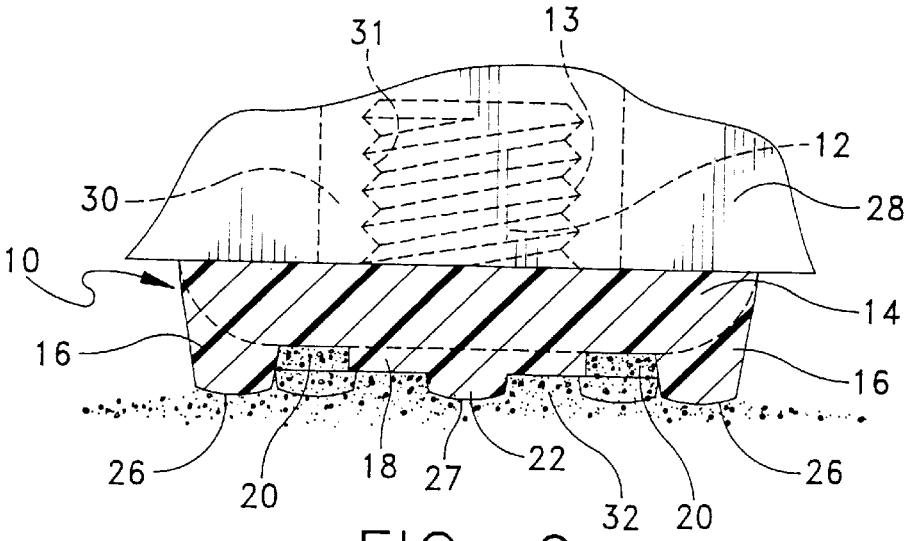
FIG. 9 is a side elevational view of the golf cleat of FIG. 1 installed in a golf shoe with packed dirt therein.
Figure 10:
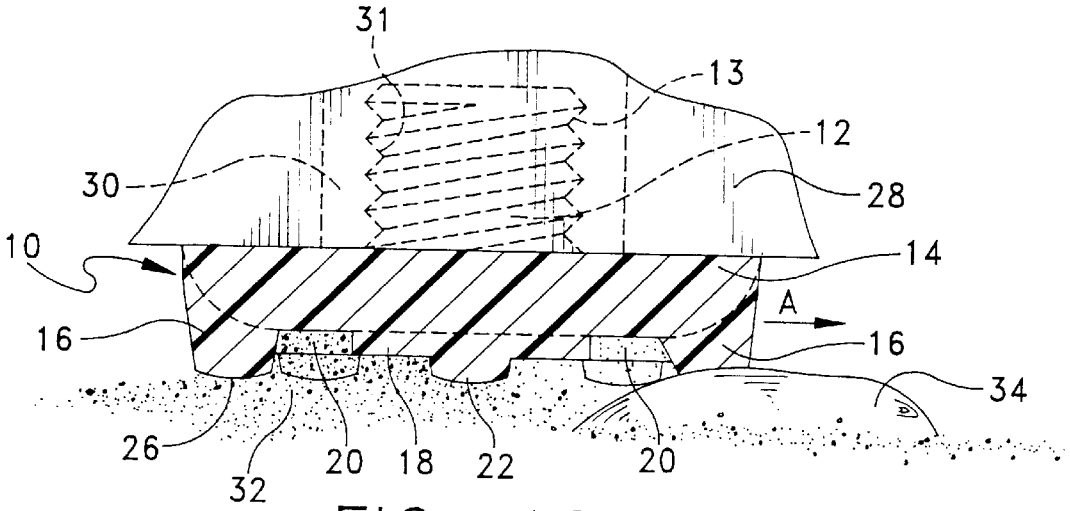
FIG. 10 is a side elevational view of the golf cleat of FIG. 1 installed in a golf shoe illustrating ejection of trapped dirt in accordance with the present invention.
Figure 11:
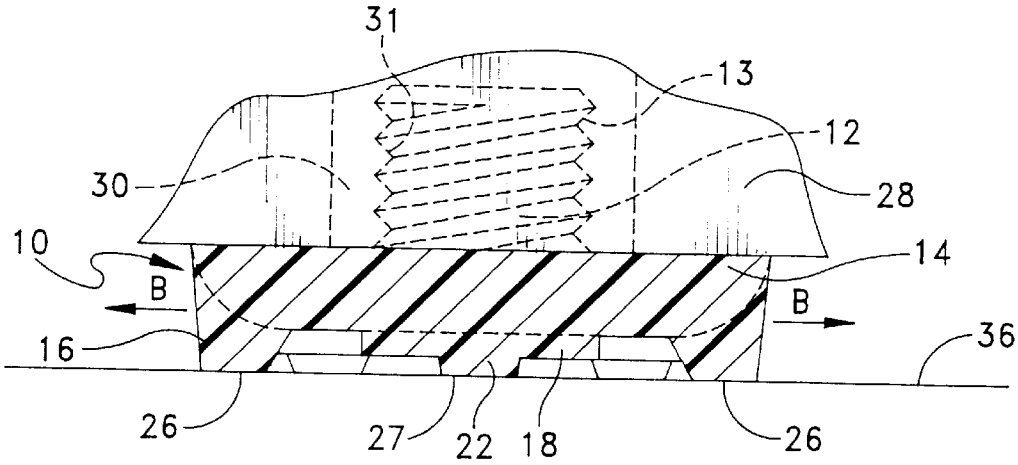
FIG. 11 is a side elevational view of the golf cleat of FIG. 1 installed in a golf shoe illustrating enhanced traction in accordance with the present invention.

Referring now to FIGS. 9–11, use of installed golf cleat 10 is shown. Referring first FIG. 9, golf cleat 10 to shown fully installed into a shoe sole 28. When in contact with dirt or other terrain 32, contact surfaces 26 of projections 16 communicate with terrain 32 to provide superior traction about the periphery of golf cleat 10. For additional support in traction, central projection 22 also communicates with terrain 32 via central projection contact surface 27. Center pad 18 provides additional support and reinforcement for projections 16 via reinforcement ribs 20. Referring to FIG. 9 in conjunction with FIG. 1, center pad 18, a pair of adjacent projections 16 and tapered edge 15 form a pie-shaped construction to further enhance traction in all directions. In general, projections 16 and 22 can flex in any direction when placed into contact with a terrain surface of resistance.

As further shown in FIG. 9, continued use of golf cleat 10 may result in the accumulation or packing of dirt or terrain material 32 between projections 16 and central projection 22. Such packing of terrain material 32 is quite common in all athletic cleat shoes. However, golf cleat 10 of the present invention includes structure for self-cleaning itself during normal use. As seen in FIG. 10, golf cleat 10 includes packed terrain material 32 in its left-most side while terrain material 32 has been ejected on its right-most side. The self-cleaning of golf cleat 10 is accomplished by a projection 16 being urged, for example, outwardly in a direction referenced "A" when placed into contact with an irregular surface 34 which can be a rock, step, or the like. This contact with an irregular surface 34 occurs during normal use. In particular, right-most projection 16 precisely adapts to irregular surface 34 to prevent slippage in that region of golf cleat 10 while simultaneously enlarging the distance between right-most projection 16 and central projection 22 to effectively dislodge and eject any terrain material 32 therebetween.

When a given projection 16 flexes to accommodate a given terrain of resistance, it flexes back immediately to its original position due to the presence of reinforcement ribs 20. Projections 16 and 22 may flex in any direction or may simply compress. Reinforcement ribs 20 provide a resilient spring-back action for each projection 16 and prevent projections 16 from tearing away from base member 14. This ensures that each projection 16 will return to the original position after accommodating a particular terrain condition. Reinforcement ribs 20 and center pad 18 serve to control the penetration of projections 16 and 22 into a given terrain such as a golf green. Ribs 20 and center pad 18 provide a stop to prevent excessive penetration by projections 16 and 22 thus preventing excessive wear of projections 16 and 22.

In view of the foregoing, "on-the-fly" customization of golf cleat 10 is carried out to accommodate the particular terrain of resistance at hand. As shown in FIG. 11, the golf cleat 10 of the present invention addresses the problem of accommodating a smooth surface 36 such as stone, tile or hardwood flooring. Typically, wearing soft-type golf cleats on such smooth services is highly dangerous due to the likelihood of slipping thereon. However, the golf cleat 10 of the present invention provides claw-like projections 16 which can spread in any direction. For example, projection 16 can spread outwardly in the direction referenced "B" to increase their respective contact surfaces 26 to provide greater traction to prevent slipping. In addition, central projection 22 also compresses due to the material employed to further increase its contact surface 27 for providing additional traction and support at the center of cleat 10. In addition, projections 16 serve as a spring cushion while walking to provide an extremely comfortable feel. Also, as the golf cleat 10 wears over time, projections 16 and 22 become more elastomeric resulting in improved gripping as the cleat 10 wears.

It should be understood that the structure of golf cleat 10 of the present invention may also be used and other athletic shoe is, such as football, baseball, and the like. In addition, the particular material employed and size may be modified in accordance with the particular traction and terrain requirements for the particular sport and the male-threaded post 12 may include a metal core for additional reinforcement and support. Still further, the array of projections may be modified to customize the cleat to the particular use.

It would be appreciated by those skilled in the art that various changes and modifications can be made to the illustrated embodiments without departing from the spirit of the present invention. All such modifications and changes are intended to be covered by the appended claims.

What is claimed is:

1. A multiple terrain demountable shoe cleat adapted to be attached to the sole of shoe, having a female threaded cleat receptacle, for engagement with a surface, comprising:

a base member having a first side adapted to abut the sole of said shoe when said cleat is mounted on said shoe and a second side;

a male threaded post connected substantially perpendicular to said first side of said base member; said male threaded post being removably engageable with said female cleat receptacle of said shoe and substantially centrally positioned on said first side of said base member;

a plurality of resilient peripheral projections connected to and extending from said second side of said base member about the periphery of said base member; said plurality of resilient projections each being flexible and movable relative to said base member;

a center pad connected to and extending from said second side of said base member; said center pad being substantially centrally positioned on said second side of said base member;

a central projection connected to and extending from said center pad; said central projection being substantially centrally positioned on said center pad;

resilient reinforcement means joining each of said plurality of peripheral projections to said center pad; said resilient reinforcement means spring-biasing said plurality of resilient projections;

whereby said plurality of resilient peripheral projections spread relative to said base member upon contact with a surface, and said plurality of resilient peripheral projections and said central projection adapt their positioning relative to one another to accommodate a surface terrain while each maintaining communication with the surface terrain and ejecting any dirt lodged within said shoe cleat.

2. The multiple terrain demountable shoe cleat of claim 1, wherein said shoe cleat is made of flexible elastomeric urethane.

3. The multiple terrain demountable shoe cleat of claim 1, wherein said resilient peripheral projections are positioned on said second side of said base member in a concentric array about a central axis; said central projection and said center pad being disposed centrally of said concentric array of resilient peripheral projections.

* * * * *